United States Patent [19]

Simson

[11] 4,340,212

[45] Jul. 20, 1982

[54] METHOD AND APPARATUS FOR PRODUCING SHEET-LIKE PRINTED PRODUCTS HAVING A FOLDED PORTION

[76] Inventor: Walter A. Simson, 230 Beverly Rd., Scarsdale, N.Y. 10583

[21] Appl. No.: 78,431

[22] Filed: Sep. 24, 1979

[51] Int. Cl.[3] ..... B41F 13/58

[52] U.S. Cl. ..... 270/5; 270/37; 270/20.1; 493/439

[58] Field of Search ..... 270/5–9, 270/41, 16, 42, 37, 18–20; 101/225, 228; 93/34, 73; 229/69, 73; 156/384, 387, 277, 442.1, 442.2; 493/187, 439, 320–325

[56] References Cited

U.S. PATENT DOCUMENTS

| | | | |
|---|---|---|---|
| 3,665,817 | 5/1972 | Katz | 270/41 |
| 3,749,631 | 7/1973 | Batchelder et al. | 156/350 |
| 3,784,185 | 1/1974 | Katz | 270/37 |
| 3,894,905 | 7/1975 | Ehlscheid | 156/384 |
| 3,899,381 | 8/1975 | O'Brien | 270/7 |
| 3,911,818 | 10/1975 | MacIlvaine | 101/52 X |
| 3,956,049 | 5/1976 | Johnsen | 156/200 |
| 3,999,746 | 12/1976 | Gendron | 270/37 |
| 4,033,807 | 7/1977 | Neill et al. | 156/384 |
| 4,047,711 | 9/1977 | Gregoire | 270/86 |
| 4,066,251 | 1/1978 | Johnsen | 207/37 |

*Primary Examiner*—William Pieprz
*Assistant Examiner*—A. Heinz
*Attorney, Agent, or Firm*—Kenyon & Kenyon

[57] ABSTRACT

A method and apparatus are disclosed for forming printed paper products having a folded or pocket portion, for example inserts for magazines and brochures having a reply envelope. A moving web of paper from which the inserts are made is first folded along the edges thereof to form the folded or envelope portion of the insert. Thereafter, printing is carried out on the folded web. Since folding precedes printing, a web having a width which exceeds the maximum width that the printing press can accommodate may be used. In this way, an insert having a width up to the maximum width that the printing press can accommodate and/or inserts having envelope portions and/or envelope flap portions of increased size are obtained.

31 Claims, 14 Drawing Figures

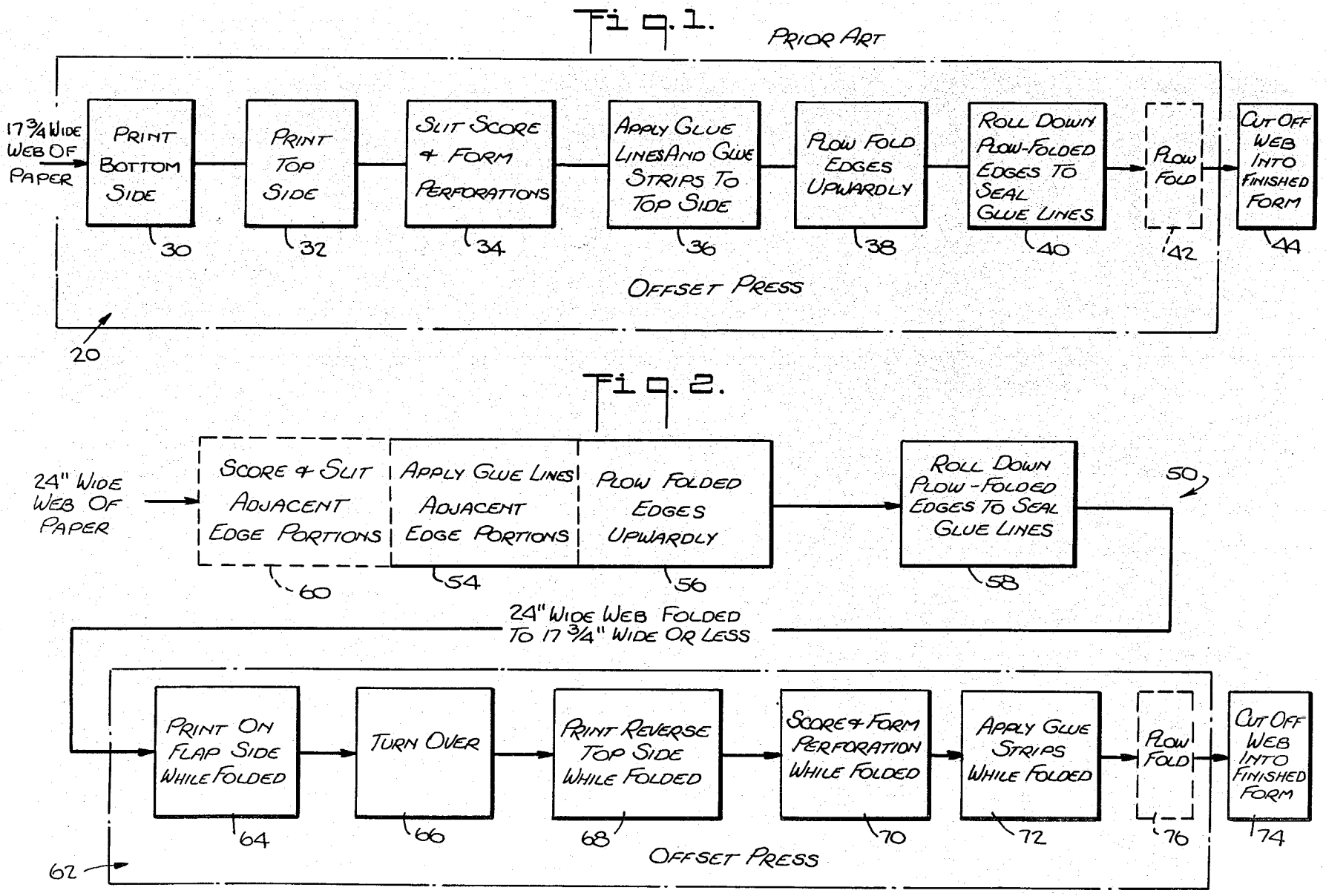
Fig. 1.
PRIOR ART
17 3/4 WIDE WEB OF PAPER
PRINT BOTTOM SIDE
30
PRINT TOP SIDE
32
SLIT SCORE & FORM PERFORATIONS
34
APPLY GLUE LINES AND GLUE STRIPS TO TOP SIDE
36
PLOW FOLD EDGES UPWARDLY
38
ROLL DOWN PLOW-FOLDED EDGES TO SEAL GLUE LINES
40
PLOW FOLD
42
CUT OFF WEB INTO FINISHED FORM
44
OFFSET PRESS
20
Fig. 2.
24" WIDE WEB OF PAPER
SCORE & SLIT ADJACENT EDGE PORTIONS
60
APPLY GLUE LINES ADJACENT EDGE PORTIONS
54
PLOW FOLDED EDGES UPWARDLY
56
ROLL DOWN PLOW-FOLDED EDGES TO SEAL GLUE LINES
58
50
24" WIDE WEB FOLDED TO 17 3/4" WIDE OR LESS
PRINT ON FLAP SIDE WHILE FOLDED
64
TURN OVER
66
PRINT REVERSE TOP SIDE WHILE FOLDED
68
SCORE & FORM PERFORATION WHILE FOLDED
70
APPLY GLUE STRIPS WHILE FOLDED
72
PLOW FOLD
76
CUT OFF WEB INTO FINISHED FORM
74
OFFSET PRESS
62

Fig. 6.
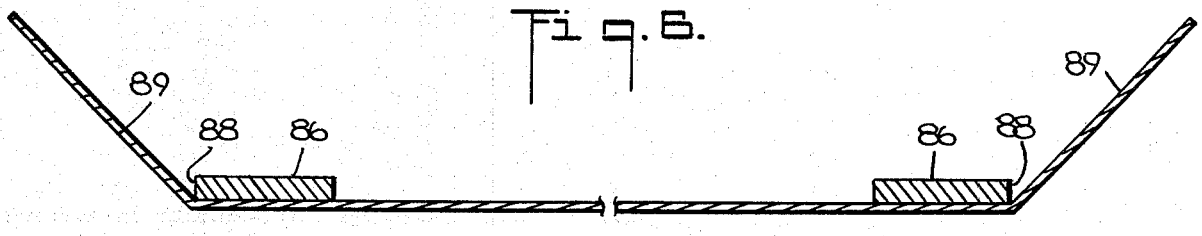
Fig. 7.
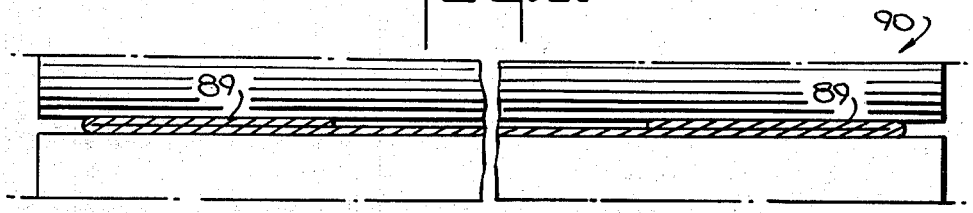
Fig. 8.
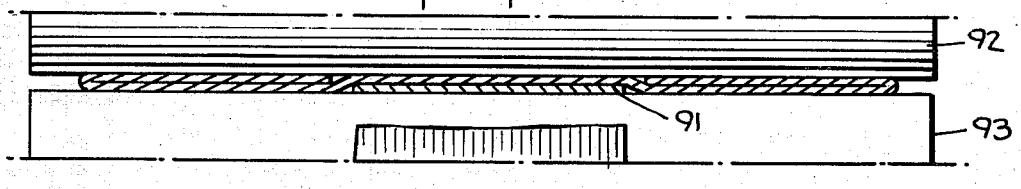
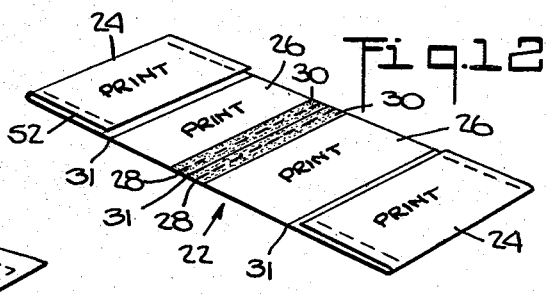
Fig. 12.
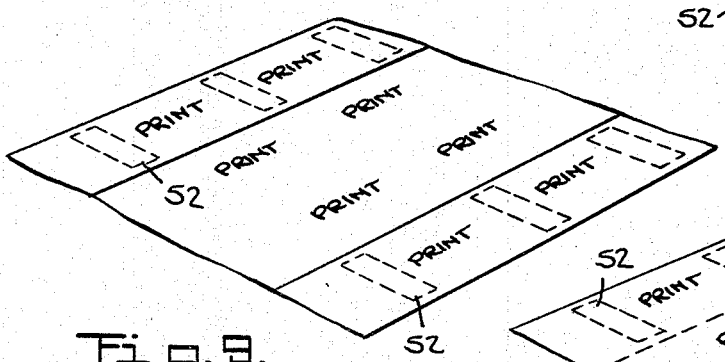
Fig. 9.
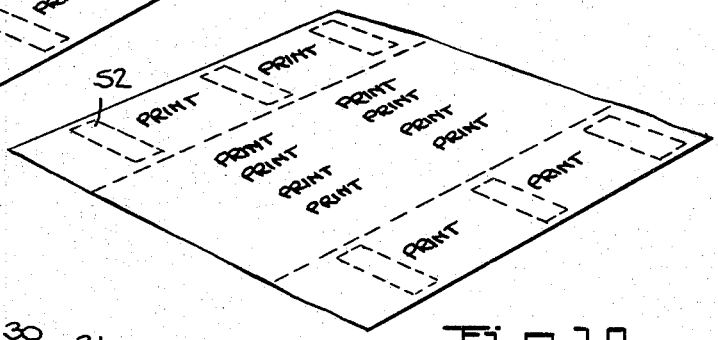
Fig. 10.
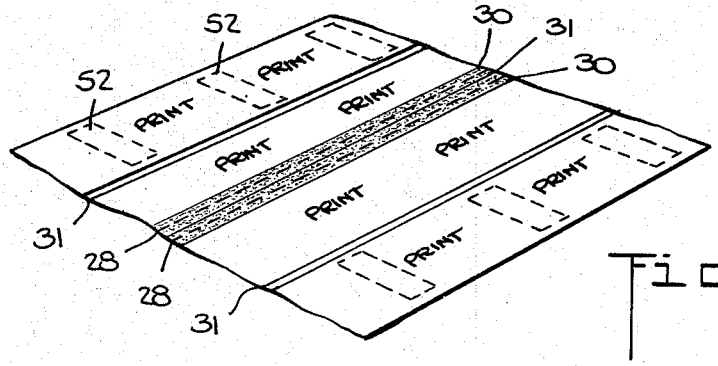
Fig. 11.

METHOD AND APPARATUS FOR PRODUCING SHEET-LIKE PRINTED PRODUCTS HAVING A FOLDED PORTION

BACKGROUND OF THE INVENTION

1. Field of the Invention

The present invention relates to the forming and printing of paper products having a folded flap, pocket, envelope or the like portion, particularly paper products made from a moving web of paper in which the opposed edges of the moving web are continually folded inwardly to form envelopes.

2. Description of the Prior Art

In known systems for forming and printing sheet-like paper products having a folded flap, pocket, envelope or the like portion, printing is applied to either or both sides of the unfolded stock or web as it is advanced and thereafter the stock or web is glued and the opposed edges thereof are folded inwardly into the desired form. As a result of folding the opposed edges inwardly the folded finished product has a width which is less than the maximum width of web which the printing apparatus can accommodate.

In the forming and printing of inserts for magazines, advertising brochures, etc. which include envelopes that may be used, for example, as reply envelopes for ordering merchandise, subscribing, etc., printing is carried out on an unfolded moving web of paper. Thereafter, the web of paper is glued and folded to form an insert having an envelope at each end. Each envelope includes a rear flap which extends over a substantial portion of the rear of the envelope when it is sealed.

Presses such as roll-fed offset printing presses currently being used for printing inserts of this type are limited with respect to the maximum width of the web of paper which can be handled. For example, a commonly used commercial offset press is limited to webs of approximately 17¾ inches maximum width. Printing, scoring, slitting, gluing, etc. are all carried out on the full width of the web prior to folding the opposed edges of the moving web by means of guides known as plows. Upon folding the web to form envelopes, the width of the finished insert is reduced to a width of substantially less than 17¾ inches. Thus, with a limit of 17¾ inches for the width of the web which can be printed on, the size of the resulting envelopes and/or the rear flaps of the envelopes, as well as the overall width of the finished insert are limited.

In order to provide larger envelopes, for example to satisfy postal regulations, it is necessary to reduce the size of the rear flap while retaining the same overall maximum size of the unfolded stock or web supplied to the printing apparatus. It has not heretofore been possible to provide an insert having an overall width which exceeds the width that the printing apparatus can accommodate.

Although U.S. Pat. Nos. 3,899,381 and 4,066,251 disclose printed products, neither relates to a paper product or insert of the type described above. U.S. Pat. No. 3,899,381, issued on Aug. 12, 1975, relates to the production of direct-mail advertising booklets from a continuous web of superposed paper-like strips or sheets. U.S. Pat. No. 4,066,251, issued on Jan. 3, 1978, relates to the production of combination mailing envelopes and return envelopes from a plurality of continuous webs of sheet material; one of the webs is folded to form a front panel of the mailing envelope and a back panel common to the mailing envelope and the return envelope.

SUMMARY OF THE INVENTION

It is an object of the present invention to manufacture printed paper products having a folded flap, pocket, envelope or the like portion in which the product and/or the folded portion may be of a size greater than the maximum size which can be produced from the widest web which can normally be employed.

It is also an object of the present invention to manufacture printed paper products having a folded flap, pocket, envelope or the like portion which may be of a size greatr than that which can be produced from the widest web which can normally be employed.

It is another object of the present invention to manufacture a printed insert having an envelope portion and a back flap portion for the envelope portion in which the insert, the envelope portion and/or the back flap portion may be of increased size.

It is still another object of the present invention to manufacture such printed paper products and inserts from a continually moving web of paper stock.

It is still another object of the present invention to provide a method and apparatus for producing such printed paper products and inserts.

It is also an object of the present invention to print on one or both sides of a continually moving web of paper having folded or pocket portions at each end.

In accordance with the present invention, folding of a web of paper stock is carried out by plows in advance of printing and the printing is applied while the stock is folded. Thus, the web of paper stock is first folded to the desired size which can be equal to the maximum size which the printing apparatus is adapted to receive and thereafter printing is applied to the folded stock. As a result, a larger size stock may be used to provide a printed product of increased size and/or to provide a product having folded portions or pockets which may be of increased size. The width of the stock fed to prior art apparatus can thereby be increased to exceed a predetermined maximum size while utilizing printing apparatus capable of accommodating up to the predetermined maximum size.

In accordance with the invention, apparatus such as a plow is provided to fold a web of paper stock before it enters the printing press. The feeding of a folded web to a printing press which is adapted to accommodate conventional width stock, i.e. stock up to the predetermined maximum size, enables the size of the folded portion, i.e. the flap, pocket or envelope, to be increased, and in the case of an insert comprising an envelope thereon, the envelope can be increased without the need for decreasing the size of the rear flap of the envelope.

Printed sheet paper products which include a folded portion at an end of the product are produced in accordance with the invention. The apparatus and method of the invention are conditioned to operate in conjunction with a printing press, the printing press in a direction transverse to the line of travel of paper stock through the printing press having a predetermined maximum dimension which fixes the maximum width of paper stock that can be printed. In accordance with the invention, at least one edge portion of paper stock having a width greater than the predetermined dimension of the printing press is folded along a fold line to provide folded paper stock of a width which is less than the predetermined dimension of the printing press and the folded paper stock is advanced to the printing press for printing while the paper stock is folded.

Adhesive may be applied to the paper stock at a predetermined location thereon which is contiguous with the edge portion after the folding thereof to secure the folded edge portion to the paper stock. The adhesive may be applied in the form of strips extending spaced apart with respect to one another and transversely with respect to the line of travel of the paper stock through the press, the strips of adhesive being adapted to secure the folded edge portion at each of the oppositely disposed ends of the printed sheet paper product.

In the disclosed embodiment, the apparatus and method are conditioned to operate in conjunction with an offset printing press having at least one printing unit including a plate cylinder, a blanket cylinder in rolling relation therewith, and an impression cylinder extending adjacent to the blanket cylinder and forming a nip therewith, or an offset perfecting press including upper and lower plate and blanket cylinders, the blanket cylinders being adjacently disposed to form a nip therebetween, the printing press in a direction transverse to the line of travel of paper stock through the printing press having a predetermined maximum dimension which fixes the maximum width of paper stock than can be printed when the paper stock is advanced through the nip.

In accordance with one aspect of the invention, the edge portion of the paper stock is folded to a position contiguous with a portion of the surface of the paper stock thereby presenting a folded portion of double thickness of paper stock and an unfolded portion of single thickness of paper stock to be printed on, the invention providing for uniformly increasing the diameter of the impression roller as determined substantially by the caliper of the paper stock to enable the unfolded portion of the paper stock and the folded portion of the paper stock to be contiguous with the blanket cylinder simultaneously when the paper stock is advanced through the nip of the blanket cylinder and the impression cylinder for printing. In accordance with the disclosed embodiment of the invention, the diameter of the cylinder may be increased by a shim plate.

In the case of a perfecting press, the surface of the blanket cylinder in contact with the folded side of the paper is modified to provide a printing surface which uniformly contacts the folded paper product when the paper is advanced through the nip of the blanket cylinders. In accordance with a disclosed embodiment, the diameter of the blanket cylinder may be increased by a shim disposed between the blanket cylinder mat surface and the cylinder core.

In the disclosed embodiments, means are provided for delivering a moving web of paper stock from a supply thereof to means for folding at least one edge portion of the paper stock. The means for delivering a moving web of paper stock comprise means in rolling engagement with the web of paper stock for delivering the web of paper stock from a supply roll thereof to the folding means. The means for folding at least one edge portion of paper stock comprises a plow member disposed contiguous with the surface of the moving web of paper stock, the outer portion of the plow member with respect to the central portion of the moving web being adjacent to the location on the moving web of the fold line, the means for advancing the folded paper stock being disposed downstream of the plow member and advancing the edge portion of the moving web transversely with respect to the central portion of the moving web commencing at the outer portion of the plow member. The means for advancing the folded paper stock comprises at least one roller rotating in engagement with the folded paper stock.

In accordance with one aspect of the invention, a method is provided for continuously producing printed sheet-like paper products each of which includes a folded flap, pocket, envelope or the like portion at each end of the product by utilizing printing apparatus which is adapted to print on a web of paper stock of a predetermined maximum width. The method comprises the steps of providing a web of paper stock having a width which exceeds the normal predetermined maximum width which the printing press can accommodate, folding the edge portions of the web of paper to provide a web of folded paper stock having a width equal to or less than the predetermined width, and printing on selected portions of the folded web of paper stock. The paper stock is advantageously an endless web of paper, and the folded and printed paper stock is severed into individual products.

The folded and printed stock may be scored and perforated prior to slitting if desired. An adhesive may be applied to secure the folded portions and an adhesive may be applied for sealing the flap portion to the envelope portion when the envelope is used.

Additionally, edge portions of the sheet stock may be scored and slit prior to applying adhesive and folding. Printing may be carried out on selected portions of both sides of the folded paper stock and the folded paper stock may be turned over after printing on one side and before printing on the other side.

Apparatus according to another aspect of the invention is provided for continuously producing printed sheet-like products each of which includes a folded flap, pocket, envelope or the like portion. The apparatus comprises means for printing on stock of a width of up to a predetermined maximum width, means for folding the excess width paper stock to provide paper stock of a width equal to or less than the predetermined width including the folded portion, and means for printing on the folded paper stock. The means for printing is positioned to receive the folded paper stock of a width up to the predetermined width and thus may be a substantially conventional means for printing, if desired.

More particularly, the means for printing may comprise a modified conventional press (modified in accordance with the invention) which receives and prints on a paper web of approximately $17\frac{3}{4}$ inches maximum width. According to one embodiment of the invention, apparatus such as plows for plow-folding the web are located ahead of the press and the folded web which is fed to the press, rather than the unfolded web, can be up to the $17\frac{3}{4}$ inches maximum width. Thus, in accordance with the invention, a web having a width such as 24 inches, for example, is supplied to the folding apparatus of the invention which is positioned in advance of the press apparatus. In the apparatus of the invention, the 24 inch web is scored, slit, and adhesive (for securing the folded portions) is applied thereto, and then the web is plow-folded into the desired width of up to $17\frac{3}{4}$ inches for feeding to the press apparatus. Thereafter, printing, scoring and the application of the adhesive (for sealing the flap when the envelope is used) are applied to the plow folded web. Since the inside surfaces of the folded parts of the sheet do not receive printing, pre-folding in accordance with the invention does not reduce the surface area available for printing.

These and other aspects of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which:

FIG. 1 is a block diagram of the steps of the method carried out by a prior art offset press system;

FIG. 2 is a block diagram of the steps of the method and apparatus of an offset press system according to the invention;

FIG. 6 is a vertical section view taken along line 6—6 of FIG. 4 showing the web being plow-folded upwardly;

FIG. 7 is a vertical section view taken along line 7—7 of FIG. 5 showing the plow-folded web being pressed between rollers;

FIG. 8 is a vertical section view taken along line 8—8 of FIG. 4 illustrating printing on the glued, folded and pressed web;

FIG. 9 is a fragmentary perspective view of the plow-folded web product having printing on one side thereof;

FIG. 10 is a fragmentary perspective view of the plow-folded web product having printing on both sides thereof;

FIG. 11 is a fragmentary perspective view of the plow-folded web product having printing, illustrating scoring and perforation lines prior to the application of glue to the flap portion;

FIG. 12 is a perspective view of an individual product severed from the web product of FIG. 11;

BRIEF DESCRIPTION OF THE PREFERRED EMBODIMENTS

Figure 3:
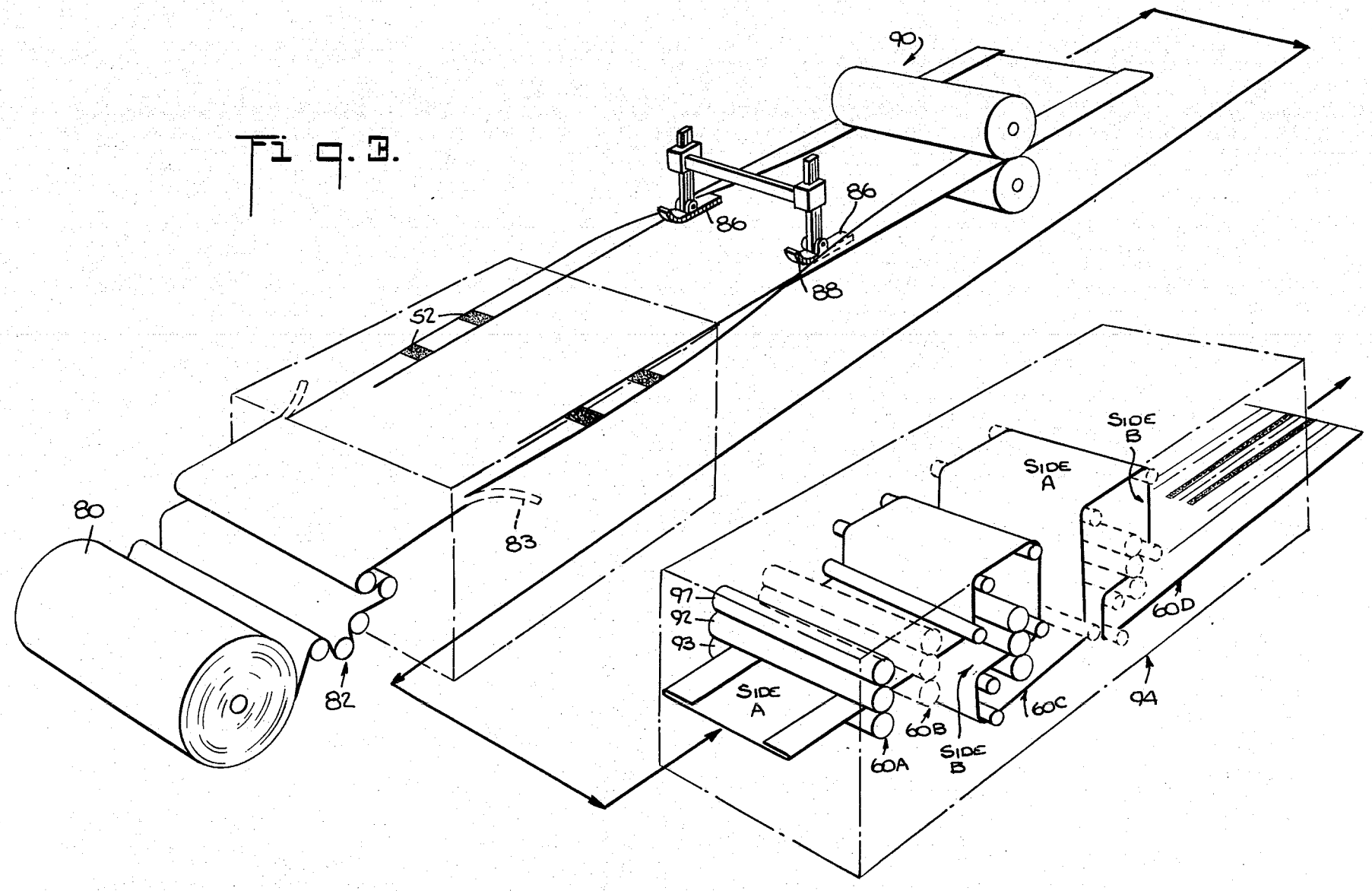
FIG. 3 is a perspective view of portions of the offset press system of the invention illustrating apparatus for slitting, plow folding, pressing and turning the web of paper over in accordance with the invention.

In the prior art offset press system illustrated by the block diagram of FIG. 1, a web of paper of a predetermined maximum width, such as approximately 17¾ inches for example, is supplied to the system 20 which forms printed envelope assemblies 22 from the web such as inserts 22 for magazines, advertising, brochures, etc., one of which is illustrated in FIG. 12. The inserts 22 each include a folded envelope or pocket portion 24 formed at each edge of the insert and envelope flap portions 26 which extend between the envelope portions 24. Perforated lines 28 are provided in the central portion of the insert in order that the insert may be separated into individual envelopes. Glue strips 30 are applied adjacent to the perforated lines 28 in order that rear flap portion 26 can be secured to the envelope portion to seal the envelope when it is ultimately used.

A web of paper of a predetermined maximum width (approximately 17¾ inches, for example) is first fed into the offset press system 20 of FIG. 1 to the printing apparatus or press of the system. Printing is carried out on one side, for example the bottom side, of the web of paper, as referenced by step 30. Conventional offset printing presses can acccommodate webs of paper of various widths to a predetermined maximum width. Therefore the printing press construction limits the maximum size of the insert which can be produced. The maximum size of the insert in turn limits the size of the envelope portion 24 and/or the back flap portion 26 of the insert.

The web is continuously fed into the offset press system 20 and printing is carried out (step 30) on a first side of the moving web in its flat, unfolded configuration. Thereafter, printing is carried out (step 32) on the other, for example the top, side. The system 20 may include apparatus for turning over the moving web of paper in order that printing is carried out from a single location above or below the web. In addition printing presses may be utilized to alternately print on opposite sides of the moving web of paper without turning the web over. If printing is desired in more than one color, the moving web of paper is advanced through a printing station for each side for each color desired.

After printing, the edges of the printed web of paper are slit and the web scored to provide score lines (score lines 31 in FIG. 12) between perforation lines in the central part of the envelope back flap portions and adjacent to the inner edge of each envelope portion to facilitate folding of the insert and folding of the flap portions when sealing individual envelopes, respectively. Perforating is also done at this time to provide the perforation lines 28 in order that the finished insert may be separated into individual envelopes. Slitting, scoring and forming the perforations is referenced by step 34 in FIG. 1. Next glue strips (strips 28 in FIG. 12) are applied adjacent to the perforated lines and glue lines (lines 52 in FIGS. 3, 5 and 9–11) are applied transversely to the edges. The glue strips are for securing the edges of the flaps when it is desired to seal the envelopes and for example may be a fast drying glue or a dry glue which is activated by the application of moisture. The application of the glues to the printed web is referenced by step 36. If desired, glue may be applied (step 36) first and the web slit and scored (step 34) thereafter. The edges of the web are next plow-folded upwardly (step 38) and the plow-folded edges are rolled down (step 40) to join the edges along the glue lines 52. A web product such as the web illustrated in FIG. 11 is obtained at this point. The glue lines 52 are of a sufficient width to permit a single glue line to be used to join the folded web in adjacent inserts when the web is cut off through the glue lines.

If desired, the web may again be plow-folded (step 42) along the central score line 31 to form a folded insert. The web is next cut off (step 44) to form the individual inserts illustrated in FIG. 12.

Thus the system 20 of FIG. 1 can provide inserts having envelope portions and flap portions of a limited size utilizing a web of paper of a given width corresponding to the maximum width which the printing apparatus can accommodate. Any increase in the size of the envelope portion results in a decrease in the size of the flap portion and vice-versa.

It is desirable to have the flap portion overlap the entire rear of the envelope portion so that, for example, different printed matter can be applied to the rear of the envelope portion and to the flap portion. In this way, the printed matter on the rear of the envelope portion and on the flap portion may be independent of each other. This has not heretofore been possible when increasing the size of the envelope portion to satisfy postal regulations.

In accordance with the invention, a web of paper can be supplied to the system 50 having a width which exceeds the maximum width which the printing apparatus can ordinarily accommodate. The web is plow-folded and the envelope portions formed before printing so that an insert having a final width which is up to the maximum width that the printing apparatus can accommodate is obtained. Thus, the web is folded ahead of the printing apparatus and the folded web is printed on. According to the invention, an insert which may be larger than the finished insert produced by the offset press system 20 and/or an insert which has larger envelope and/or larger flap portions can be obtained.

Figure 5:
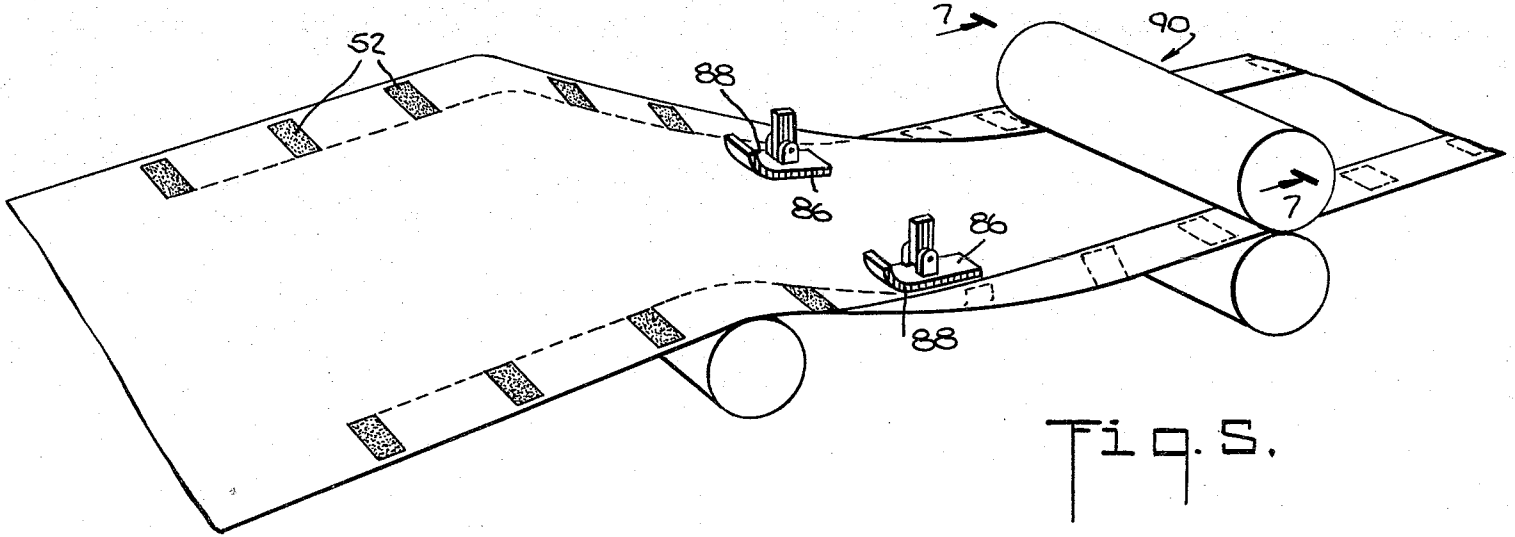
FIG. 5 is a fragmentary enlarged perspective view of the apparatus of FIG. 3 for plow-folding and pressing the folded web.

In the system 50 of FIG. 2, according to the invention, a web of paper which is wider than the maximum width which the printing apparatus can accommodate is delivered to the system. For example, a web of paper of a 24 inch width is supplied to the system 50 in which the press is adapted to receive a web no greater in width than about 17¾ inches. Prior to printing, glue lines are applied adjacent to the edge portions of the moving web of paper in transversely extending lines 52 (FIG. 5). The edge portions bearing the glue lines are then plow-folded upwardly. The glue applying and plow-folding steps are referenced by steps 54 and 56, respectively, in FIG. 2. Thereafter, the plow-folded and glued edges are press-rolled (step 58) to join the glued edges and form the envelope portions. If desired, adjacent edge portions of the web may be scored and slit (step 60) to trim the web of paper prior to the application of the glue lines 52. A kit or attachment as shown for example in FIG. 13 and described below may be provided in accordance with the invention which includes apparatus to carry out the foregoing steps.

The moving web of paper with the plow-folded envelope portions is fed to an offset printing press referenced as step 62. The moving web of paper is first printed on one side (step 64), for example the flap side, while folded. The moving web of paper is thereafter turned over (step 66) and printing is carried out on the reverse side (step 68), again while the moving web of paper is folded. FIG. 9 illustrates the web of paper after printing is carried out on the flap side and FIG. 10 illustrates the web of paper after printing is carried out on the reverse side.

The printed and folded web of paper is next scored and the perforations formed (step 70). As illustrated in FIG. 11, score lines 31 are formed along the center of the web and adjacent envelope portions 24, and perforated lines 28 are formed adjacent to the central score line on both sides thereof. As mentioned, the score lines 31 facilitate folding the web along the central score line and the folding of the flap portions onto the envelope portions in the finished insert (FIG. 12). The insert may be separated along the perforated lines to form two envelopes. The central score line may be slit in order to provide to two separate envelopes instead of folding along that score line.

Glue (fast drying or dry glue, for example) is next applied (step 72) along strips 30 adjacent to the perforated lines and thereafter the web is cut off to form the individual inserts shown in FIG. 12. Alternatively, glue may be applied (step 72) first and the web slit and scored (slip 70) thereafter. If desired, the web may be again plow-folded (step 76) to form a folded insert prior to cutting off.

Figure 4:
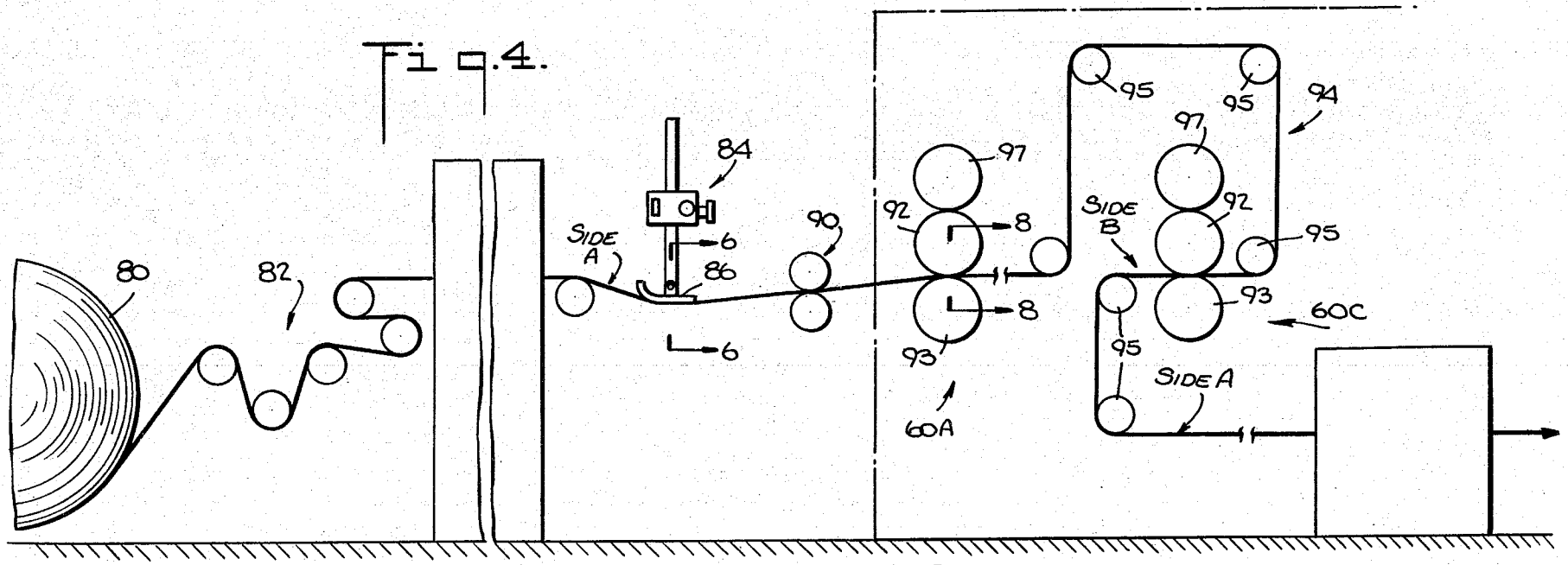
FIG. 4 is a fragmentary elevation view of the apparatus of FIG. 3.

Referring more particularly now to FIGS. 3–5, the larger width web of paper 80 for example, a 24 inch web of paper, is fed to the system via drive and tension rollers 82. If desired, the edge portions 83 of the web of paper are scored and slit (FIG. 2, step 60) and thereafter glue is applied in conventional fashion in transversely-extending lines 52 progressing inwardly from the edges of the web. Plow-folders 84 are located after the glue applying station (step 54) and act to fold the edges of the moving web upwardly. The plow shoes 86 contact the moving web of paper inwardly of the glue lines 52 with the respective outside edges 88 of the plow shoes forming the fold line, the position of the shoe thereby determining the width of the folded edge of the web of paper and correspondingly the width of the envelope portions 24.

As shown in FIG. 6, the edges 89 of the web of paper are folded upwardly along the outside edges 88 of the plow shoes 86. The moving web of paper progresses towards opposed press rollers 90 (or S-loop press rollers 90A in FIG. 13) which act to press the edges of the web of paper having the glue lines 52 thereon against interior portions of the web to join the folded edges of the web as shown in FIG. 7.

The folded web is then advanced to the printing apparatus 60A (FIG. 3) and the flap side of the web is printed first. It may be necessary, depending upon the thickness of material and nature of printing, to compensate for the double thickness of paper at the folded portions during printing. For example, it may be possible to see a break in printing at the transition from single to double thickness, particularly where a color is printed across the transition. In order to deliver the web as a flat surface to the blanket cylinder 92 of the printing apparatus, a shim 91 (FIG. 8) may be wrapped around and secured to the circumference of impression cylinder 93. The plate cylinder is referenced by 97. The width of the shim 91 substantially corresponds to the space between the folded side portions. Thus the shim 91 positions the central portion of the web into the plane of the folded portions during passage beneath the blanket 92 for printing.

After printing on the flap side, the folded web of paper (FIG. 9) is supplied to the turn-over apparatus 94 (FIG. 4) which comprises a series of rollers 95. However, other turn-over apparatus known in the art may be used in place of apparatus 94. The web of paper enters the turn-over apparatus 94 with the flap side (side A) up and leaves the turn-over apparatus 94 with the flap side (side A) down. The turned-over web is now fed to another stage of the printing apparatus 60C and the reverse side (side B) is printed. A shim similar to the shim 91 shown in FIG. 8 may be secured to the impression cylinder in order that the central portion of the web is even with the blanket during printing. The web with printing on both sides is illustrated in FIG. 10. If printing of multiple colors is desired, the moving web is delivered to additional printing stations for each side and for each color desired. For example, if printing of two colors is desired on each side, the web is fed through two printing presses, then the web is turned over and then the web is fed through two more printing presses. As illustrated in FIG. 3 printing on side A is applied in one color by press 60A and in another color by press 60B. The web is turned over by rollers 95 and printing is applied in two colors on side B by presses 60C and 60D.

Figure 13:
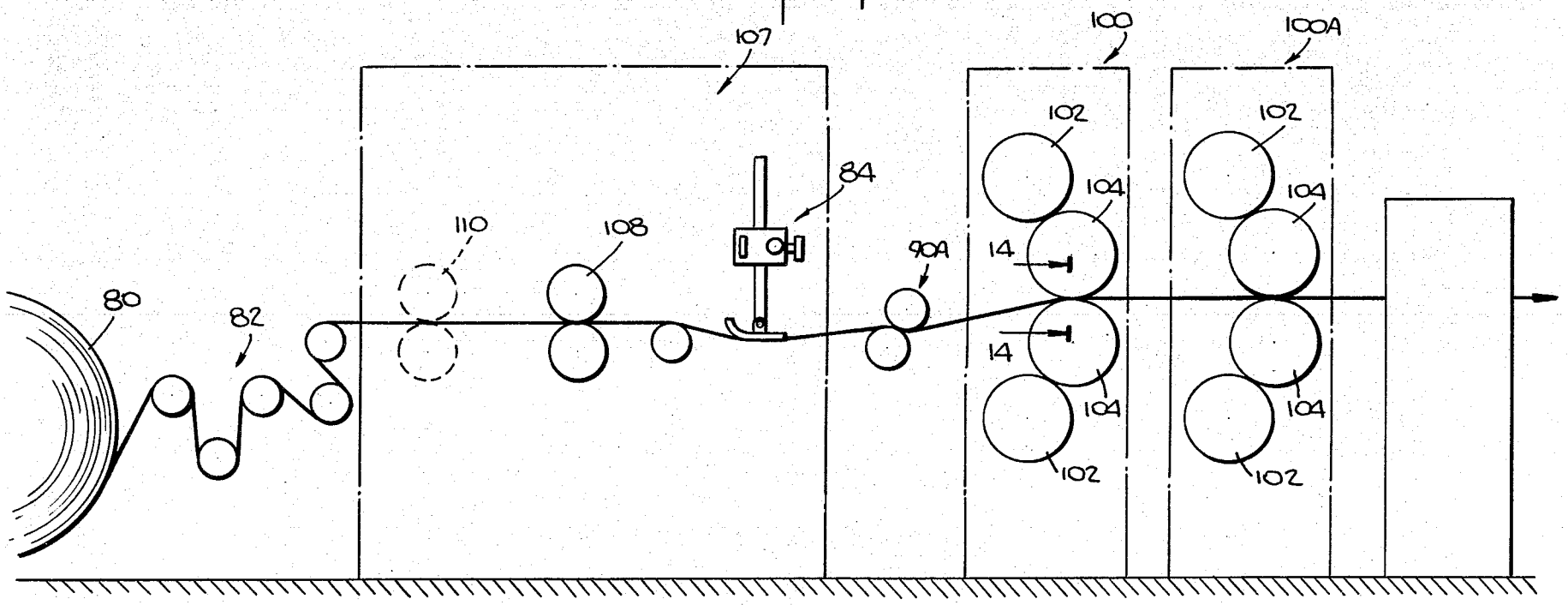
FIG. 13 is a fragmentary elevation view of apparatus according to another embodiment of the invention.
Figure 14:
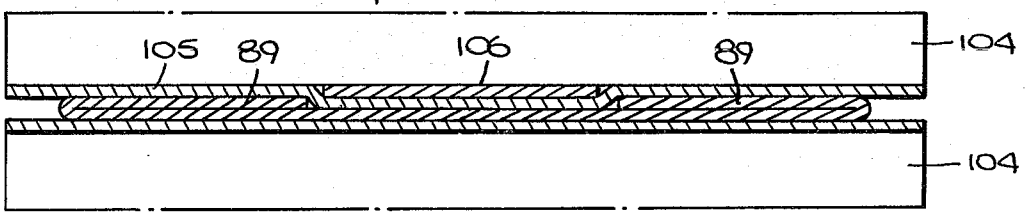
FIG. 14 is a vertical section view taken along line 14—14 of FIG. 13 illustrating printing on the glued, folded and pressed web.

Printing may also be carried out simultaneously on both sides of the moving web. As illustrated in FIG. 13, an offset perfecting press 100 may be utilized to simultaneously print on both sides of the web. Additional perfecting presses 100A may be provided for different colors to be printed. The perfecting press 100 includes opposed sets of plate 102 and blanket 104 cylinders. Each blanket cylinder utilizes the blanket cylinder on the opposed side of the web as an impression cylinder. Again, it may be necessary to compensate for the double thickness of paper at the folded portions during printing. In order to deliver the web as a flat surface to the blanket cylinders 104 of the perfecting printing press, the diameter of the blanket cylinder on the double thickness side of the web is increased in the region between the folded portions (FIG. 14). The width of the increased diameter portion substantially corresponds to the space between the folded side portions. Thus, the mat surface 105 of the upper blanket cylinder will uniformly contact the web surface. For example, a shim 106 may be placed between the blanket cylinder core and the mat surface of the blanket cylinder to enlarge the diameter of the overall cylinder in the central region thereof.

After printing has been carried out on one or both sides of the moving web, the web is scored, the perforations are formed, the glue strips are applied and the web is cut-off as described above.

The printed folded web shown in FIGS. 9–12 has a maximum width of 17¾ inches as opposed to the unfolded maximum width web of 17¾ inches which is printed on in the prior art systems. In accordance with the invention, a web, wider approximately 24 inches in width for example, is supplied to the system as compared to a web of 17¾ inches for prior art systems. Thus, up to 6¼ inches of web are available over prior art systems to increase the size of the insert and/or the size of the envelope and/or back flap portions.

The apparatus used to carry out the glue applying, folding, rolling and scoring and slitting (optional) steps (54, 56, 58 and 60, respectively, illustrated in FIG. 2) can be supplied as a kit or attachment in accordance with one aspect of the invention. Such a kit 107 is illustrated in FIG. 13 and includes apparatus 108 for applying the glue lines 52 and the plow folder 84. The kit may also include the scoring and slitting apparatus 110, if desired. The kit 106 receives paper web having a width wider that can be accommodated by the printing apparatus, for example, approximately 24 inches. The larger width web is plow folded by the kit to a width which can be accommodated by the printing apparatus, for example, approximately 17¾ inches. Thus, the apparatus downstream of the kit 107 accommodates web having a width no larger than a width which conventional apparatus can accommodate.

The apparatus used to carry-out the printing, turnover (when not utilizing a perfecting press), scoring and perforating, glue applying, plow folding and slitting steps (64, 66, 68, 70, 72, 74 and 76, respectively, illustrated in FIG. 2) can be conventional with the printing presses modified in accordance with the invention. Thus, existing apparatus (modified as taught herein) possessed by a manufacturer can be utilized to carry out certain steps of the manufacture, and a kit 107 may be provided to be disposed ahead of the existing, modified apparatus. As a result, new postal regulations requiring larger envelopes can be satisfied using the invention herein and existing equipment to manufacture the inserts.

While the invention has been described in connection with printing apparatus capable of accommodating a web width of up to approximately 17¾ inches and a larger web of approximately 24 inches width which, in accordance with the invention, is folded to up to the 17¾ inch width prior to printing, such widths have been chosen for purposes of illustration and are merely examples it is not intended that the invention be limited by such exemplary widths. Additionally, while in preferred embodiments, glue has been applied in glue lines 52 for securing the folded portion of the web to the remainder of the web, it is understood that a product can be made in accordance with the invention in which the folded part is not secured to the remainder of the web. When such a product is made, the glue is of course not applied. Furthermore, the invention is not limited to use with offset printing processes as the invention may be practiced in conjunction with other printing processes such as rotogravure, flexigraphic and letter press, to name a few.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What is claimed is:

1. Apparatus for producing printed sheet paper products from paper stock, each of the paper products including a folded portion at an end of the product, the apparatus being conditioned to operate in conjunction with a printing press utilizing opposed rotating cylindrical surfaces for printing on paper stock, the printing press in a direction transverse to a path of travel of paper stock through the printing press having a predetermined width which fixes the maximum width of paper stock that can be printed, the apparatus comprising:

means for folding at least one edge portion of paper stock having an original width greater than the predetermined width of the printing press along a fold line offset from the midpoint of the original width to provide folded paper stock of a folded width which is less than the predetermined width of the printing press with at least one folded edge portion overlying only a fraction of the remaining width of paper stock; and means for advancing the folded paper stock to the printing press for printing while the paper stock is folded with the at least one folded edge portion overlying only a fraction of the remaining width of paper stock.

2. Apparatus in accordance with claim 1 and further comprising means for delivering a moving web of paper stock from a supply thereof to the means for folding at least one edge portion of the paper stock.

3. Apparatus in accordance with claim 2 in which the means for delivering a moving web of paper stock comprise means in rolling engagement with the web of paper stock for delivering the web of paper stock from a supply roll thereof to the folding means.

4. Apparatus in accordance with claim 2 in which the means for folding at least one edge portion of paper stock comprises a plow member disposed contiguous with the surface of the moving web of paper stock, said plow member having an outer portion which, with respect to the central portion of the moving web, is adjacent to the location on the moving web of the fold line, the means for advancing the folded paper stock being disposed downstream of the plow member and advancing the edge portion of the moving web transversely with respect to the central portion of the moving web commencing at the outer portion of the plow member.

5. Apparatus in accordance with claim 4 in which the means for advancing the folded paper stock comprises at least one roller rotating in engagement with the folded paper stock.

6. Apparatus in accordance with claim 4 in which the means for advancing the folded paper stock comprises a pair of rollers disposed parallel and adjacent to one another to form a nip through which the moving web can be advanced, the pair of rollers, when contiguous with folded paper stock being advanced thereby, pressing the folded edge portion to be contiguous with the remainder of the web of paper stock.

7. Apparatus in accordance with claim 1 and further comprising means for applying adhesive to the paper stock at a predetermined location thereon which is contiguous with the edge portion after the folding thereof to secure the folded edge portion to the paper stock.

8. Apparatus in accordance with claim 7 in which the means for applying adhesive to the paper stock applies adhesive in the form of spaced strips extending spaced apart with respect to one another and transversely with respect to the path of travel of the paper stock through the press, the strips of adhesive being adapted to secure the folded edge portion at each of the oppositely disposed ends of the printed sheet paper product.

9. In an offset printing press having at least one printing unit including a plate cylinder, a blanket cylinder in rolling relation therewith, and an impression cylinder extending adjacent to the blanket cylinder and forming a nip therewith, the printing press in a direction transverse to a path of travel of paper stock through the offset printing press having a predetermined width which fixes the maximum width of paper stock that can be printed when the paper stock is advanced through the nip of the blanket cylinder and the impression cylinder, apparatus for producing printed sheet paper products from paper stock, each of the paper products including a folded portion at at least one end of the products comprising:

means for folding at least one edge portion of paper stock having an original width greater than the predetermined width of the offset printing press along a fold line offset from the midpoint of the original width to provide folded paper stock of a folded width which is less than the predetermined width of the offset printing press with at least one folded edge portion overlying only a fraction of the remaining width of paper stock; and means for advancing the folded paper stock to the nip of the blanket cylinder and the impression cylinder of the offset printing press for printing while the paper stock is folded with the at least one folded edge portion overlying only a fraction of the remaining width of paper stock.

10. Apparatus in accordance with claim 9 in which the means for folding at least one edge portion of paper stock folds the edge portion to a position contiguous with a portion of the surface of the paper stock thereby presenting a folded portion of double thickness of paper stock and an unfolded portion of a single thickness of paper stock to be printed by the offset printing press, and which further comprises means adapted to be mounted contiguously about the impression cylinder in alignment with the path of travel of the unfolded portion of the paper stock when being advanced to the offset printing press for uniformly increasing the diameter of the impression roller as determined substantially by the caliper of the paper stock, the diameter increasing means being positioned adjacent to the unfolded portion of the paper stock so as to make the unfolded portion contiguous with the blanket cylinder simultaneously with the folded portion being contiguous with the blanket cylinder when the paper stock is advanced through the nip of the blanket cylinder and the impression cylinder for printing.

11. Apparatus in accordance with claim 10 in which the diameter increasing means comprises a shim plate.

12. In an offset printing press having at least one printing unit including for each side of paper stock being printed a plate cylinder and a blanket cylinder in rolling relation therewith, the blanket cylinders extending adjacent to each other and forming a nip, the printing press in a direction transverse to a path of travel of paper stock through the offset printing press having a predetermined width which fixes the maximum width of paper stock that can be printed when the paper stock is advanced through the nip of the blanket cylinders, apparatus for producing printed sheet paper products from the paper stock, each of the paper products including a folded portion at at least one end of the product, comprising:

means for folding at least one edge portion of paper stock having an original width greater than the predetermined width of the offset printing press along a fold line offset from the midpoint of the original width to provide folded paper stock of a folded width which is less than the predetermined width of the offset printing press with at least one folded edge portion overlying only a fraction of the remaining width of paper stock; and means for advancing the folded paper stock to the nip of the blanket cylinders of the offset printing press for printing while the paper stock is folded with the at least one folded edge portion overlying only a fraction of the remaining width of paper stock.

13. Apparatus in accordance with claim 12 in which the means for folding at least one edge portion of paper stock folds the edge portion to a position contiguous with a portion of the surface of the paper stock thereby presenting a folded portion of double thickness of paper stock and an unfolded portion of a single thickness of paper stock to be printed by the offset printing press, and which further comprises means for increasing the diameter of the blanket cylinder as determined substantially by the caliper of the paper stock on a side of the paper stock presenting the folded portion of double thickness, the diameter increasing means being positioned adjacent to the unfolded portion of the paper stock so as to make the unfolded portion contiguous with the blanket cylinder on the side of the paper stock having the single thickness simultaneously with the folded portion being uniformly contacted by the blanket cylinder of increased diameter when the paper stock is advanced through the nip of the blanket cylinders.

14. Method for producing printed sheet paper products from paper stock, each of the paper products including a folded portion at at least one end of the product, the method being conditioned to operate in conjunction with a printing press utilizing opposed rotating cylindrical surfaces for printing on paper stock, the printing press in a direction transverse to a path of travel of paper stock through the printing press having a predetermined width which fixes the maximum width of paper stock that can be printed, the method comprising:

folding at least one edge portion of paper stock having an original width greater than the predetermined width of the printing press along a fold line offset from the midpoint of the original width to provide folded paper stock of a folded width which is less than the predetermined width of the printing press with at least one folded edge portion overlying only a fraction of the remaining width of paper stock; and advancing the folded paper stock to the printing press for printing on the at least one folded edge portion and at least part of the remaining width while the paper stock is folded.

15. Method in accordance with claim 14 and further continuously delivering a moving web of paper stock from a supply thereof for folding.

16. Method in accordance with claim 14 and further comprising applying adhesive to the paper stock at a predetermined location thereon which is contiguous with the edge portion after the folding thereof to secure the folded edge portion to the paper stock.

17. Method for producing printed sheet paper products from paper stock, each of the paper products including a folded portion at at least one end of the product, the method being conditioned to operate in conjunction with an offset printing press having at least one printing unit including a plate cylinder, a blanket cylinder in rolling relation therewith, and an impression cylinder extending adjacent to the blanket cylinder and forming a nip therewith, the printing press in a direction transverse to a path of travel of paper stock through the offset printing press having a predetermined width which fixes the maximum width of paper stock that can be printed when the paper stock is advanced through the nip of the blanket cylinder and the impression cylinder, the method comprising:

folding at least one edge portion of paper stock having an original width greater than the predetermined width of the offset printing press along a fold line offset from the midpoint of the original width to provide folded paper stock of a folded width which is less than the predetermined width of the offset printing press with the at least one edge portion overlying only a fraction of the remaining width of paper stock; and advancing the folded paper stock to the nip of the blanket cylinder and the impression cylinder of the offset printing press for printing on the at least one folded edge portion and at least part of the remaining width while the paper stock is folded.

18. Method in accordance with claim 17 in which the at least one edge portion of the paper stock is folded to a position contiguous with a portion of the surface of the paper stock thereby presenting a folded portion of double thickness of paper stock and an unfolded portion of single thickness of paper stock to be printed by the offset printing press, and which further comprises:

uniformly increasing the diameter of the impression roller as determined substantially by the caliper of the paper stock to position the unfolded portion of the paper stock to be contiguous with the blanket cylinder simultaneously with the folded portion being contiguous with the blanket cylinder when the paper stock is advanced through the nip of the blanket cylinder and the impression cylinder for printing.

19. Method for producing printed sheet paper products from paper stock, each of the paper products including a folded portion at at least one end of the product, the method being conditioned to operate in conjunction with an offset printing press having at least one printing unit including for each side of the paper stock a plate cylinder and a blanket cylinder in rolling relation therewith, the blanket cylinders extending adjacent to each other and forming a nip, the printing press in a direction transverse to a path of travel of paper stock through the offset printing press having a predetermined width which fixes the maximum width of paper stock that can be printed when the paper stock is advanced through the nip of the blanket cylinders, the method comprising:

folding at least one edge portion of paper stock having an original width greater than the predetermined width of the offset printing press along a fold line offset from the midpoint of the original width to provide folded paper stock of a folded width which is less than the predetermined width of the offset printing press with the at least one folded edge portion overlying only a fraction of the remaining width of paper stock; and advancing the folded paper stock to the nip of the blanket cylinders for printing on the at least one folded edge portion and at least part of the remaining width while the paper stock is folded.

20. Method in accordance with claim 19 in which the at least one edge portion of the paper stock is folded to a position contiguous with a portion of the surface of the paper stock thereby presenting a folded portion of double thickness of paper stock and an unfolded portion of single thickness of paper stock to be printed by the offset printing press, and which further comprises:

uniformly increasing the diameter of the blanket cylinder on the side of the paper stock presenting the folded portion of double thickness as determined substantially by the caliper of the paper stock to position the unfolded portion of the paper stock to be contiguous with the blanket cylinder on the side of the paper stock having the single thickness simultaneously with the folded portion being uniformly contacted by the blanket cylinder of increased diameter when the paper stock is advanced through the nip of the blanket cylinders.

21. A method for continuously producing printed sheet-like paper products each of which includes a folded portion at each end of the product utilizing printing apparatus having a predetermined width and which utilizes opposed rotating cylindrical surfaces for printing on paper stock, the method comprising the steps of:

providing paper stock having an original unfolded width which exceeds said predetermined width;

folding the edge portions of the paper stock along fold lines offset from the midpoint of the original unfolded width to provide folded paper stock having a folded width up to the predetermined width with each of the edge portions overlying only a fraction of the remaining width of paper stock; and printing on selected portions of the folded paper stock including at least one edge portion and at least part of the unfolded width of the stock.

22. Method in accordance with claim 21 and further comprising delivering a moving web of paper stock from a supply thereof for folding.

23. Method in accordance with claim 21 and further comprising applying adhesive to the paper stock at a predetermined location thereon which is contiguous with the edge portion after the folding thereof to secure the folded edge portion to the paper stock.

24. Apparatus for continuously producing printed sheet-like paper products each of which includes a folded portion at each end of the product utilizing printing apparatus having a predetermined width and which utilizes opposed rotating cylindrical surfaces for printing on paper stock, the apparatus comprising:

means for folding the edge portions of the paper stock along fold lines offset from the midpoint of the original unfolded width to provide folded paper stock having a folded width up to the predetermined width with each of the edge portions overlying only a fraction of the remaining width of paper stock; and said printing apparatus which prints on selected portions of the folded paper stock of up to the predetermined width, said printing apparatus being positioned after said means for folding, said printing apparatus receiving the folded paper stock and printing on at least one edge portion and at least part of the unfolded width of the paper stock.

25. Apparatus in accordance with claim 24 in which the means for delivering a moving web of paper stock comprise means in rolling engagement with the web of paper stock for delivering the web of paper stock from supply roll thereof to the folding means.

26. Apparatus in accordance with claim 24 and further comprising means for delivering a moving web of paper stock from a supply thereof to the folding means.

27. Apparatus in accordance with claim 26 in which the folding means comprises plow members disposed contiguous with the surface of the moving web of paper stock, the plow members having outer portions which, with respect to the central portion of the moving web, are adjacent to the location on the moving web of the fold lines, the means for delivering the folded paper stock being disposed downstream of the plow members and advancing the edge portion of the moving web transversely with respect to the central portion of the moving web commencing at the outer portion of the plow members.

28. Apparatus in accordance with claim 27 in which the means for delivering the folded paper stock comprises at least one roller rotating in engagement with the folded paper stock.

29. Apparatus in accordance with claim 27 in which the means for delivering the folded paper stock comprises a pair of rollers disposed parallel and adjacent to one another to form a nip through which the moving web can be advanced, the pair of rollers when contiguous with folded paper stock being advanced thereby pressing the folded edge portion to be contiguous with the remainder of the web of paper stock.

30. Apparatus in accordance with claim 24 and further comprising means for applying adhesive to the paper stock at a predetermined location thereon which is contiguous with the edge portion after the folding thereof to secure the folded edge portion to the paper stock.

31. Apparatus in accordance with claim 30 in which the means for applying adhesive to the paper stock applies adhesive in the form of spaced strips extending spaced apart with respect to one another and transversely with respect to the line of travel of the paper stock through said printing apparatus, the strips of adhesive being adapted to secure the folded edge portion at each of the oppositely disposed ends of the printed sheet paper product.

* * * * *

UNITED STATES PATENT AND TRADEMARK OFFICE

CERTIFICATE OF CORRECTION

PATENT NO. : 4,340,212

DATED : July 20, 1982

INVENTOR(S) : Walter A. Simson

It is certified that error appears in the above-identified patent and that said Letters Patent are hereby corrected as shown below:

Column 2, line 14, delete "greatr" and insert --greater--

Column 8, line 23, delete "shoe" and insert --shoes--

Column 16, line 4, after "from" insert --a--

Signed and Sealed this

*Twenty-first* Day of *September 1982*

[SEAL]

*Attest:*

GERALD J. MOSSINGHOFF

*Attesting Officer*

*Commissioner of Patents and Trademarks*